US005090615A

United States Patent [19]

Hopkins et al.

[11] Patent Number: 5,090,615

[45] Date of Patent: Feb. 25, 1992

[54] CONTAINER/LID ASSEMBLY

[75] Inventors: Brian D. Hopkins; Matthew W. Lorence, both of Omaha, Nebr.

[73] Assignee: Conagra, Inc., Omaha, Nebr.

[21] Appl. No.: 640,646

[22] Filed: Jan. 14, 1991

[51] Int. Cl.[5] ..... B65D 43/08

[52] U.S. Cl. ..... 229/125.35; 229/125.33

[58] Field of Search ..... 229/125.33, 125.35; 206/604, 620, 633, 631

[56] References Cited

U.S. PATENT DOCUMENTS

| | | | |
|---|---|---|---|
| 3,349,985 | 10/1967 | Salway | 206/633 |
| 3,495,758 | 2/1970 | Wienecke, Jr. . | |
| 4,252,268 | 2/1981 | Haire . | |
| 4,257,530 | 3/1981 | Faller | 229/125.35 |
| 4,834,247 | 5/1989 | Oshima et al. . | |
| 4,880,112 | 11/1989 | Conrad | 206/633 |
| 4,889,239 | 12/1989 | Sandish et al. | 206/620 |
| 4,903,842 | 2/1990 | Tokuda et al. | 206/604 |
| 4,925,035 | 5/1990 | Hünninghaus . | |
| 4,939,332 | 7/1990 | Hahn . | |
| 4,962,849 | 10/1990 | Anderson | 206/631 |

*Primary Examiner*—Stephen Marcus
*Assistant Examiner*—Christopher McDonald
*Attorney, Agent, or Firm*—Willian Brinks Olds Hofer Gilson & Lione

[57] ABSTRACT

A package of the type having a container with a bottom surface, a peripheral wall, and a peripheral lip includes a lid secured to the peripheral lip. At least one side flap is secured to the lid and is oriented to extend away from the lid toward the bottom surface, and at least one bottom flap is secured to the side flap and to the bottom surface. The side edges of the lid and the side flap define a plane oriented substantially perpendicular to the lid such that the package is stable when resting on the side edges of the lid and the side flap. At least a portion of the side edge of the bottom flap is angled away from this plane toward the bottom surface. The side flap is oriented perpendicular to both the lid and the plane defined by the side edges of the lid and side flap.

17 Claims, 3 Drawing Sheets

FIG. 1
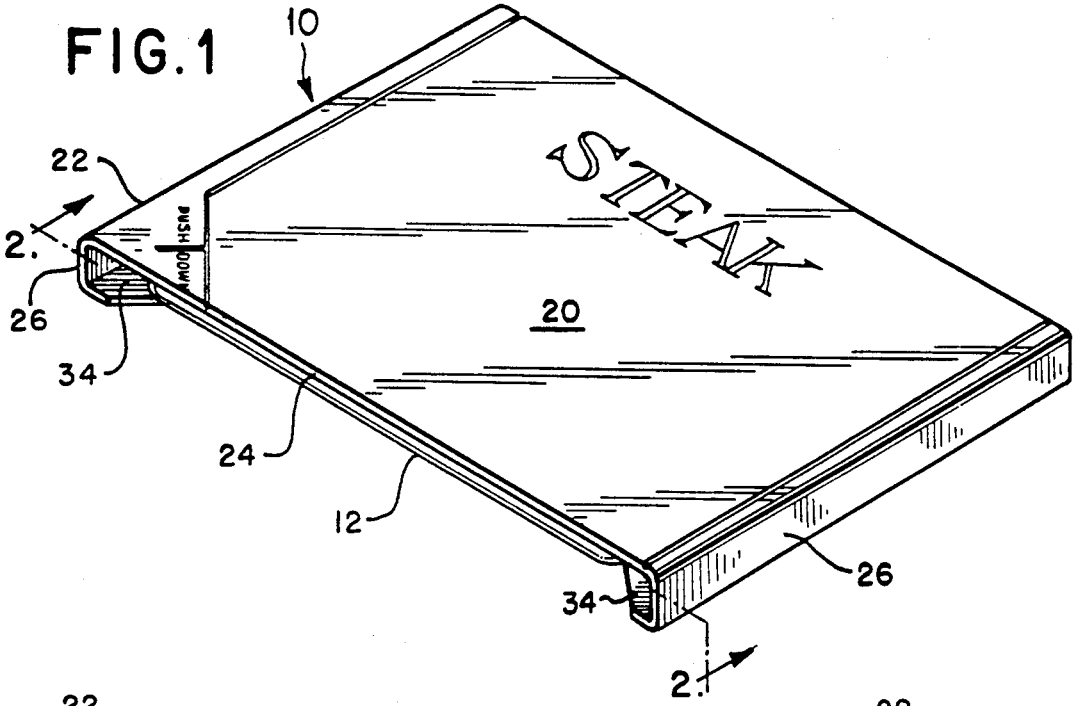
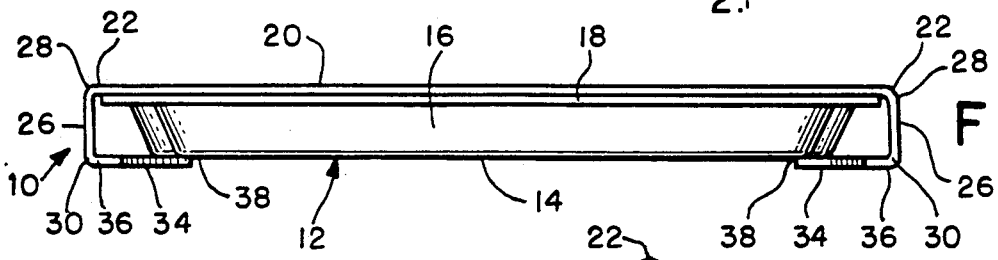
FIG. 2
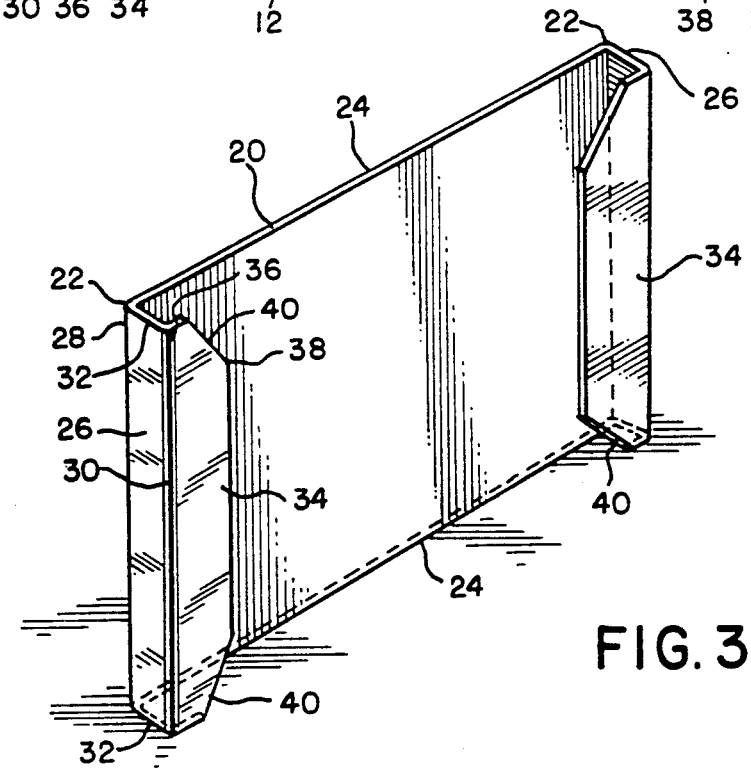
FIG. 3

CONTAINER/LID ASSEMBLY

BACKGROUND OF THE INVENTION

This invention relates to packages of the type having a container comprising a bottom surface, a peripheral wall surrounding the bottom surface, and a peripheral lip surrounding the peripheral wall, wherein the container is closed by a lid secured to the container lip.

Wienecke U.S. Pat. No. 3,495,758 discloses one package of the general type described above. In the Wienecke package the lid 14 is provided with edge flaps 22, 18; 32, 31; 43, 48 which extend between the upper and lower surfaces of the Container. The center portion of the lid is secured to the peripheral lip of the container, and the edge flaps of the lid are secured to the bottom surface of the container.

The container lid disclosed in the Wienecke patent accomplishes the stated objective of increasing the label area in a cost effective manner. However, the Wienecke lid exhibits certain disadvantages. In the arrangement shown in FIG. 2 the central lid 21 and the flaps 22, 18 are all equal in width. When such a lid is used with a container having tapered side walls as shown in FIG. 4, there is a tendency for the corner of the lid at the flap 18 to protrude objectionably and provide a snagging corner. The lids shown in FIGS. 5 and 6 of Wienecke solve this problem. However, the lids of FIGS. 5 and 6 are not well suited to support the container in an upright position when resting on one edge or to provide a stable pushing surface. Because both the flaps 31 and 32 taper progressively away from the side edge of the central lid 31, the flaps 31, 32 will allow the container to tip rearwardly if an attempt is made to stand the container on its edge or to move vertically if multiple containers are pushed together while being conveyed.

Furthermore, the preferred arrangement of the Wienecke patent angles the side flap 22 inwardly as shown in FIG. 4, such that the side flap 22 is disposed at an acute angle with respect to the center lid 21. This orientation for the side flap 22 can make it more difficult to push a row of adjacent containers as they are conveyed throughout a plant due to the lack of vertical pushing surfaces between containers.

It is a primary object of this invention to provide an improved container which largely or completely overcomes the aforementioned disadvantages of the Wienecke patent.

SUMMARY OF THE INVENTION

According to a first aspect of this invention, a package of the type described initially above is provided with at least one side flap secured to the lid, and at least one bottom flap secured between the side flap and the bottom surface. The side and bottom flaps are configured to support the package in a stable configuration when resting on the side edges of the lid and the side flap, while avoiding snagging problems associated with the bottom flap. This can be done by forming the first and second edges of the side flap and the first edge of the bottom flap of equal length and longer than the second edge of the bottom flap secured to the bottom surface. Preferably, the side edges of the lid and the side flap define a plane oriented substantially perpendicular to the lid such that the package is stable when resting on the side edges of the lid and the side flap, and at least a portion of the side edge of the bottom flap is angled away from the plane defined by the side edges of the lid and the side flap, toward the bottom surface.

According to a second aspect of this invention a package of the type described initially above is provided with at least one side flap secured to the lid and oriented to extend toward the bottom surface and at least one bottom flap secured to the side flap and to the bottom surface. The bottom flap is oriented substantially parallel to the lid, and the side flap is oriented substantially perpendicular to the bottom flap and to the lid.

BRIEF DESCRIPTION OF THE DRAWINGS

FIG. 1 is a perspective view of a package which incorporates a first preferred embodiment of this invention.

FIG. 2 is a side view taken along line 2—2 of FIG. 1.

FIG. 3 is a perspective view showing the lid of the package of FIG. 1 resting on the side surfaces of the lid and side flaps, with the container deleted for clarity of illustration.

DETAILED DESCRIPTION OF THE PRESENTLY PREFERRED EMBODIMENTS

Figure 4:
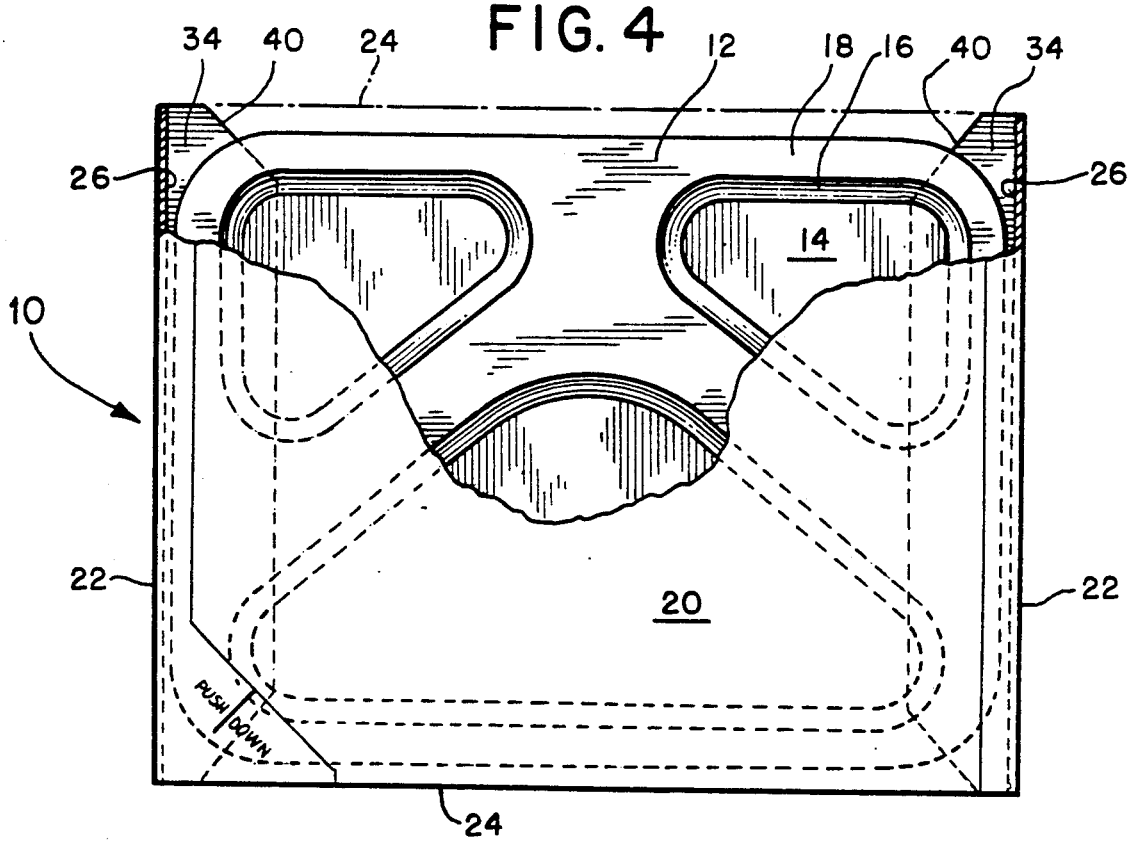
FIG. 4 is a top view taken of the package of FIG. 1.
Figure 5:
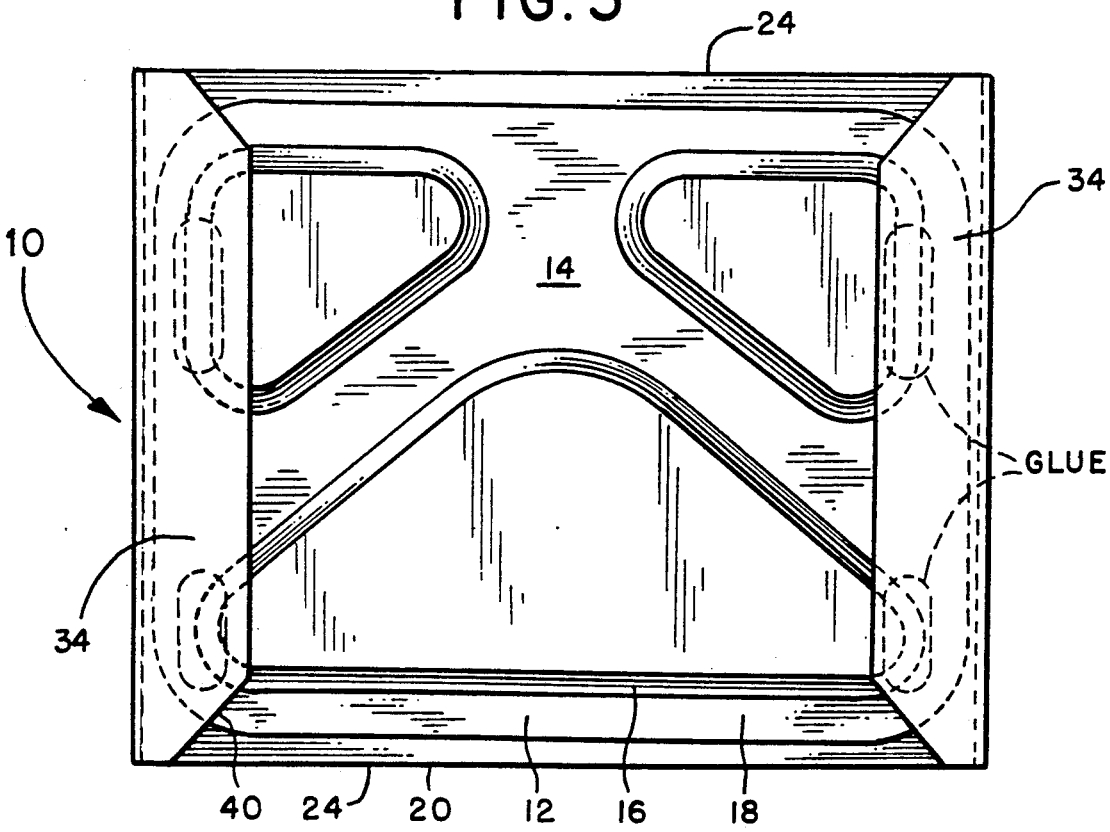
FIG. 5 is a bottom view of the package of FIG. 1.

Turning now to the drawings, FIGS. 1–5 show various views of a package 10 which incorporates a presently preferred embodiment of this invention. The package 10 includes a tray shaped container 12 having a bottom surface 14 which is surrounded by an upstanding peripheral wall 16 that terminates in a peripheral lip 18. The container 12 may for example be a tray suitable for use with a T.V. dinner.

The package 10 also includes a lid 22 having shorter end edges 22 and longer side edges 24 (FIGS. 1–5). The end edges 22 are connected to side flaps 26. Each of the side flaps 26 defines a first side flap edge 28, a second side flap edge 30 and a side edge 32 extending therebetween. Each of the side flaps 26 is in turn connected to a bottom flap 34, and each of the bottom flaps 34 defines a first bottom flap edge 36, a second bottom flap edge 38 and a side bottom flap edge 40 extending therebetween. The lid 20 defines score lines 50 at which the lid is cut to 50% its thickness. The score lines 50 form an opening feature that allows a user to remove the central portion of the lid 20 easily in order to gain access to the contents of the package 10. Preferably the outer score line is formed on the outer, printed side of the lid 20 and the inner score line is formed on the inner, unprinted side of the lid 20.

Figure 6A:
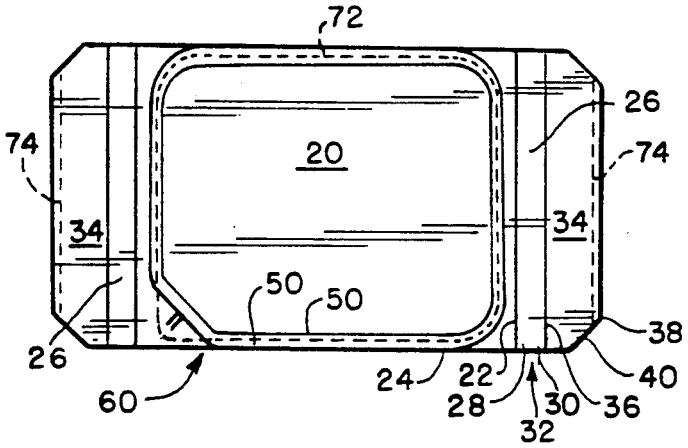
FIG. 6*a* is a plan view of an unfolded blank used in the manufacture of the package of FIG. 1.

As shown in FIG. 6*a*, the lid 20, side flaps 26 and bottom flaps 34 are preferably formed as a one piece integral sheet. Reference numeral 60 is used to indicate the unfolded blank. The blank 60 is folded as shown in FIG. 1, and the lid 20 is secured to the peripheral lip 18 at a bonding line 72, and the second edges 38 of the bottom flaps 34 are secured to the bottom surface 14 at selected locations along bonding lines 74.

As best shown in FIGS. 1 and 3, the lid 20 has been designed so as to brace the package 10 when stood up on edge. Note that the side edge 24 of the lid 20 and the side edges 32 of the side flaps 26 define a plane, and that portions of the side edges 40 of the bottom flaps 34 lie in this plane. Of course, the side edges 32, 40 could be notched or recessed in part and still define the desired plane. These side edges support the package 10 when stood up on edge, with the side edges 24, 32, 40 in contact with the support surface (not shown). Additionally, the coplanar side edges 24, 32, 40 provide stable pushing surfaces when the packages 10 are pushed in a row of adjacent packages. These advantageous results are obtained without protruding corners that are easily snagged. This is because the side edges 40 are in part angled away from the support plane, toward the bottom surface 14. In this way, both objectives are met. As best shown in FIG. 6*a*, the first and second edges 28, 30 of the side flaps 26 are equal in length to the side edges 24 of the lid 20, but are longer than the second edges 38 of the bottom flaps 34.

As shown in FIG. 2, the bottom flap 34 is parallel to the lid 20, and the side flap 26 is perpendicular to the lid 20. This arrangement has been found to provide a number of important advantages. First, since the side flaps 26 are oriented vertically when the package 10 is oriented as shown in FIG. 2, stacking strength is increased as compared with a package with angled side flaps.

Second, when two or more of the packages 10 are stacked one above the other, the side flaps 26 transmit much of the weight from the side flap 26 of an upper package to the side flap 26 of a lower package. In this way, much of the weight is supported away from the score line 50. In the past, it has been found that in the absence of vertical side flaps 26 as shown in FIG. 2, the weight of stacked packages can actually rupture the lid at the score line 50. The disclosed structure avoids this problem to a large extent.

Third, even after the central panel of the lid 20 is removed at the score line 50, the side flaps 26 and bottom flaps 34 cooperate with remaining portions of the lid 20 to rigidify the tray and make it easier to carry and use without spilling its contents.

Fourth, when the side flaps 26 are oriented vertically as shown in FIG. 2 the packages 10 can easily be pushed in a row of adjacent packages, one behind the other. The vertical side flaps 26 provide stable pushing surfaces, and substantially reduce any tendency of the packages to move vertically when conveyed.

Figure 6B:
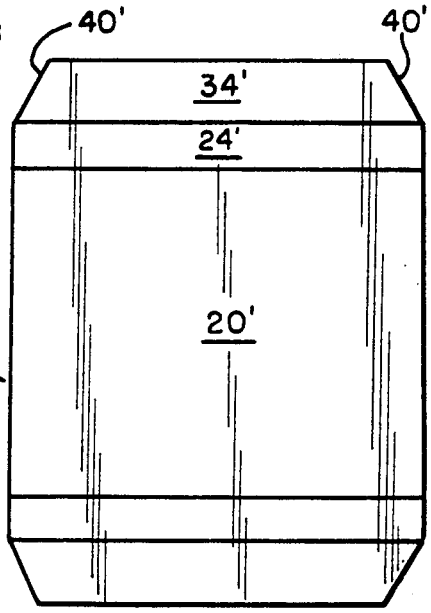
FIGS. 6*b*–6*d* are plan views of unfolded blanks of three alternative embodiments.
Figure 6D:
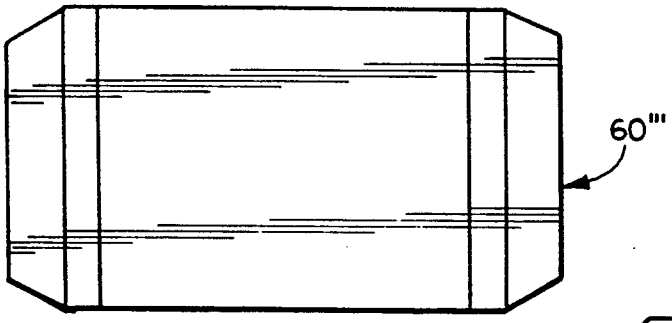
Figure 6C:
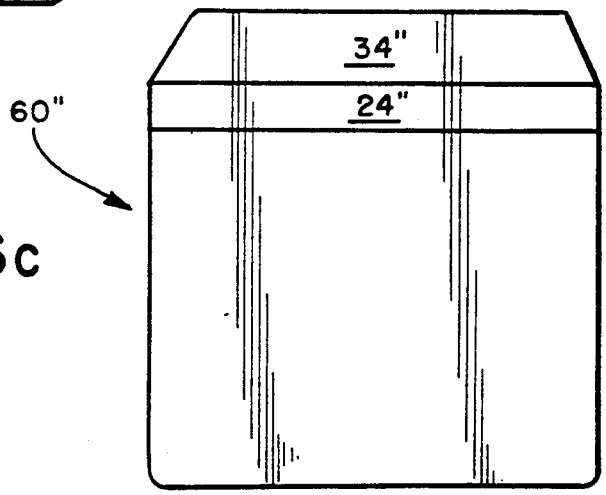

FIGS. 6*b*–6*d* show unfolded blanks 60', 60'', 60''' of three alternative embodiments. In the blank 60' of FIG. 6*b* the entire side edge 40' of the bottom flap 34' angles away from the plane defined by the side edges of the side flaps 24' and lid 20'.

The blank 60'' of FIG. 6*c* is similar to that of the blank 60' described above, except that only a single side flap 24'' and only a single bottom flap 34'' are provided.

The unfolded blank 60''' of FIG. 6*d* is also similar to the blank 60' described above, except the proportions have been varied somewhat.

The following details of construction are provided in order to define the best mode of the invention. Of course, it should be understood that these details are provided only by way of illustration, and that they are not intended to limit the present invention in any way.

The container 12 may be formed of a paper based material such as a milk carton stock supplied by International Paper as liquid packaging board coated on one side with a polyester dual ovenable coating. Alternative materials include molded paper pulp with a polyester coating or any other suitable plastic or paper based material, with or without special coatings, polymers or adhesives. The choice of material will typically be dictated by the application.

The lid 20 is preferably formed of a paperboard material such as a solid bleached sulfate clay coated on one side with a polyester dual ovenable coating to seal to the lip 18 of the container 12. Alternatives include any other suitable plastic or paper based material with or without special coatings, polymers or adhesives. As before, the choice of material will typically be dictated by the application.

Both the container 12 and the lid 20 may be made of materials that are heatable in either a conventional oven or a microwave oven, or alternately material suitable only for microwave heating may be preferred. The thickness of the stock for the container 12 and the lid 20 may range between 0.014 and 0.026 inches. At present a thickness of about 0.018 inch is preferred for the lid 20 and a thickness of about 0.021 inch is preferred for the container 12.

The lid 20 is preferably heat sealed to the lip 18 with the polyester coatings described above. Other sealing approaches may of course be substituted. The bottom flaps 34 are preferably adhered to the bottom surface 14 with a hot melt adhesive such as Swift Adhesive #888-02 (Reichhold Chemical, Swift Adhesive Division) to tack the flaps 34, and a cold vinyl adhesive such as JEDBOND #71-240E (Jedco Chemical Corp). Alternately, either the hot melt or the cold vinyl adhesive may be used alone.

Of course, it should be understood that a wide range of changes and modifications can be made to the preferred embodiments described above. For example, the lid may be tacked to the upper portion of the container at spaced apart locations, and other means, such as a film, may be used to seal the container. The bottom flaps may be shaped as desired, and rounded side edges may be preferred. The side and bottom flaps described above may be applied to any combination of the sides of the package, on one, two, three or four sides. It is therefore intended that the foregoing detailed description be regarded as illustrative rather than limiting, and that it be understood that it is the following claims, including all equivalents, which are intended to define the scope of this invention.

I claim:

1. In a package of the type comprising a container comprising a bottom surface, a peripheral wall surrounding the bottom surface, and a peripheral lip surrounding the peripheral wall; and a lid secured to the peripheral lip; the improvement comprising:

at least one side flap having a first edge secured to the lid and a second edge, the side flap oriented to extend away from the lip toward the bottom surface; and at least one bottom flap having a first edge secured to the second edge of the side flap and a second edge secured to the bottom surface;

the first and second edges of the side flap and the first edge of the bottom flap being equal in length and longer than the second edge of the bottom flap, each of the lid, side flap, and bottom flap defining at least one side edge; the side edges of the lid and side flap defining a plane oriented substantially perpendicular to the lid such that the package is stable when resting on the side edges of the lid and side flap, toward the bottom surface.

2. The invention of claim 1 wherein the lid and bottom flap are oriented parallel to one another, and wherein the lid and the side flap are oriented perpendicular to one another.

3. The invention of claim 1 wherein the at least one side flap comprises two opposed side flaps, and wherein the set of bottom flaps comprises two bottom flaps, each secured to a respective one of the side flaps.

4. The invention of claim 1 wherein the container is shaped to define a food tray.

5. In a package of the type comprising a container comprising a bottom surface, a peripheral wall surrounding the bottom surface, and a peripheral lip surrounding the peripheral wall; and a lid secured to the peripheral lip; the improvement comprising:

at least one side flap secured to the lid and oriented to extend toward the bottom surface;

at least one bottom flap secured to the side flap and to the bottom surface;

each of the lid, side flap, and bottom flap defining at least one side edge;

the side edges of the lid and side flap defining a plane oriented substantially perpendicular to the lid such that the package is stable when resting on the side edges of the lid and side flap;

at least a portion of the side edge of the bottom flap angled away from the plane defined by the side edges of the lid and side flap, toward the bottom surface.

6. The invention of claim 5 wherein the lid and bottom flap are oriented parallel to one another, and wherein the lid and the side flap are oriented perpendicular to one another.

7. The invention of claim 5 wherein the at least one side flap comprises two opposed side flaps, and wherein the at least one bottom flap comprises two bottom flaps, each secured to a respective one of the side flaps.

8. The invention of claim 5 wherein a portion of the side edge of the bottom flap adjacent the side flap is coplanar with the plane defined by the side edges of the lid and side flap.

9. The invention of claim 5 wherein the container is shaped to define a food tray.

10. In a package of the type comprising a container comprising a bottom surface, a peripheral wall surrounding the bottom surface, and a peripheral lip surrounding the peripheral wall; and a lid secured to the peripheral lip; the improvement comprising:

a set of side flaps comprising at least two opposed side flaps secured to the lid and oriented to extend toward the bottom surface;

a set of bottom flaps comprising at least two bottom flaps each secured to a respective one of the side flaps and to the bottom surface, wherein the two bottom flaps are spaced apart from one another;

the bottom flaps oriented substantially parallel to the lid;

the side flaps oriented substantially perpendicular to the bottom flap and to the lid;

each of said bottom flaps extending over less than half of the bottom surface;

said lid defining a central portion and an opening feature that extends at least partially around the central portion to facilitate removal of the central portion, said opening feature disposed between the side flaps such that the side flaps are positioned away from the opening feature.

11. The invention of claim 10 wherein the container is shaped to define a food tray.

12. The invention of claim 10 wherein the opening feature comprises at least one score line.

13. In a package of the type comprising a container comprising a bottom surface, a peripheral wall surrounding the bottom surface, and a peripheral lip surrounding the peripheral wall; and a lid secured to the peripheral lip, the lid defining a side edge and two opposed end edges; the improvement comprising:

said and second side flaps, each secured to a respective one of the end edges of the lid;

first and second bottom flaps, each secured to a respective one of the side flaps and to the bottom surface;

the side flaps oriented parallel to one another and perpendicular to the lid;

the side and bottom flaps each defining a respective side edge;

the side edges of the lid and side flaps defining a plane oriented substantially perpendicular to the lid such that the package is stable when resting on the side edges of the lid and side flap;

at least a portion of the side edges of the bottom flaps angled away from the plane defined by the side edges of the lid and side flaps, toward the bottom surface;

said lid defining a central portion and an opening feature that extends at least partially around the central portion to facilitate removal of the central portion, said opening feature disposed between the side flaps such that the side flaps are positioned away from the opening feature.

14. The invention of claim 13 wherein the container is shaped to define a food tray.

15. The invention of claim 13 wherein a portion of the side edges of the bottom flaps adjacent the respective side flaps is coplanar with the plane defined by the side edges of the lid and side flaps.

16. The invention of claim 13 wherein the side edge of the lid is longer than each of the end edges of the lid.

17. The invention of claim 13 wherein the opening feature comprises at least one score line.

* * * * *

UNITED STATES PATENT AND TRADEMARK OFFICE

CERTIFICATE OF CORRECTION

PATENT NO. : 5,090,615

DATED : February 25, 1992

INVENTOR(S) : Brian D. Hopkins et al.

It is certified that error appears in the above-identified patent and that said Letters Patent is hereby corrected as shown below:

In column 1, line 14, please delete "Container" and substitute therefor --container--.

In column 2, line 22, after "view" please delete "taken".

In claim 13, line 7, please delete "said" and substitute therefor --first--.

Signed and Sealed this

Tenth Day of August, 1993

*Attest:*

Michael K. Kirk

MICHAEL K. KIRK

*Attesting Officer*

*Acting Commissioner of Patents and Trademarks*